United States Patent [19]

Batts

[11] 4,192,441

[45] Mar. 11, 1980

[54] CLAMP CONSTRUCTION FOR ARTICLE HANGERS

[75] Inventor: John H. Batts, Grand Rapids, Mich.

[73] Assignee: John Thomas Batts, Inc., Zeeland, Mich.

[21] Appl. No.: 925,112

[22] Filed: Jul. 17, 1978

[51] Int. Cl.[2] ..... A47J 51/14

[52] U.S. Cl. ..... 223/96; 24/137 R

[58] Field of Search ..... 223/91, 93, 96; 24/137 R, 137 A, 252 R, 255 R, 67.5

[56] References Cited

U.S. PATENT DOCUMENTS

| | | | |
|---|---|---|---|
| 3,277,899 | 10/1966 | Dekel | 24/252 R |
| 3,698,043 | 10/1972 | Batts | 223/91 |
| 3,906,957 | 9/1975 | Weston | 24/255 R |
| 4,023,721 | 5/1977 | Erthein | 223/96 |

*Primary Examiner*—George H. Krizmanich

*Attorney, Agent, or Firm*—Price, Heneveld, Huizenga & Cooper

[57] ABSTRACT

An article clamping and supporting device suitable for displaying merchandise or for use with and incorporation into a garment hanger is disclosed. The device has inner and outer jaws designed to be joined by integral hinges and folded together to form a "clothes-pin" type of garment hanger. The jaws of the device are formed by inner and outer panels integrally joined by hinges which permit the outer panels to be folded to seat against the inner panels and detachably locked thereto. A spring biases the clamp into closed position. The spring seats over the folded inner panels and between these and the outer panels and is, thus, totally concealed from both front and back and largely concealed from the sides.

21 Claims, 18 Drawing Figures

CLAMP CONSTRUCTION FOR ARTICLE HANGERS

BACKGROUND OF THE INVENTION

The present invention relates to article hangers and, particularly, to a clamping device usable on garment hangers which device has a one-piece body and handle portions to facilitate opening and basically concealed spring means to bias the jaws of the clamp into article gripping position.

Clamping devices of this type have a wide range of uses including garment hangers and devices for suspending articles for display. Molded plastic garment hangers having integral article clamping means have been long known and widely used including those having a pair of pivoted jaws held closed by an integral latching device. Such a device is disclosed in U.S. Pat. No. 3,745,616 entitled CLAMP WITH IMPROVED LATCH, issued July 17, 1973. Also, known and extensively used in the apparel field are garment hangers having clamping devices which are spring biased to closed position. Such a hanger is disclosed in U.S. Pat. No. 3,767,092 entitled GARMENT CLAMPING HANGER WITH SLIDABLE LOCKING CLIP, issued Oct. 23, 1973. Also known are article hangers having the so-called "clothes-pin" type clamps which consist of two or more pieces. Examples of this type of articles clamping device are disclosed in U.S. Pat. Nos. 2,666,240, entitled CLIP FOR CLOTHES RACKS, issued Jan. 19, 1954, 2,665,466 entitled HINGED MEMBER RESTRAINING MEANS, issued Jan. 24, 1954, and Des. 212,444 entitled CLAMP FOR CLOTHES HANGERS, DISPLAY BOARDS, OR SIMILAR APPLICATIONS, issued Oct. 15, 1968.

BRIEF DESCRIPTION OF THE INVENTION

This invention is an improvement over both of these types of hangers in that while it has the desirable feature of a spring providing a closing bias for the jaws of the clamp and has a pair of upstanding finger pads which may be pinched together against the bias of the spring to open the clamp, it also has jaws of a simple, basically flat design which are integral, permitting the entire clamp, except for the spring, to be molded as a single piece. The invention provides a clamp body in which both jaws and the hinge joining structure are molded as a single integral piece and then folded into the final shape of the clamp. The spring is then attached. Once this has been done, the jaws are bias closed by the spring and may be opened by gripping the upstanding finger pad portions and pressing them together without releasing or otherwise displacing the spring. The spring is confined within the body of the clamp where it is both concealed and shielded from contact with the articles. Thus, the appearance of the device is so improved that it can be used at the retail or display level of merchandising and need not be plated or otherwise treated for stain and corrosion prevention.

BRIEF DESCRIPTION OF THE DRAWINGS

FIG. 7 is a front elevation view of the clamp similar to FIG. 1 but illustrating the clamp with one of the outer panels pivoted into open position.

DESCRIPTION OF THE PREFERRED EMBODIMENT

The invention can be applied to a simple article clamp as well as to a device with an integral hook whereby the article clamp can be supported from a peg or bar and can also be applied to a garment hanger such as one for slacks or skirts. The principle of the invention remains the same in each case. For the purpose of clarity, the invention will describe in its simplest form, that being the article clamp without a hook.

Figure 2:
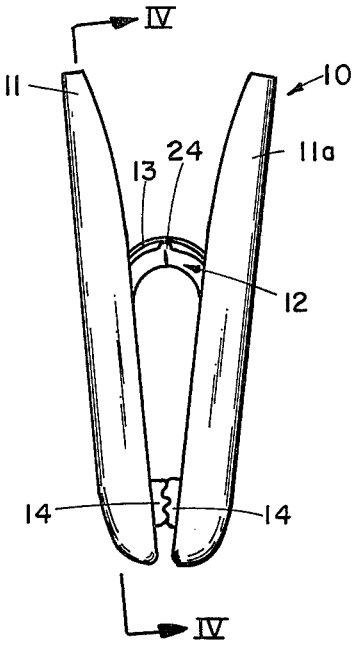
FIG. 2 is a side elevation view of the clamp illustrated in closed position.
Figure 3:
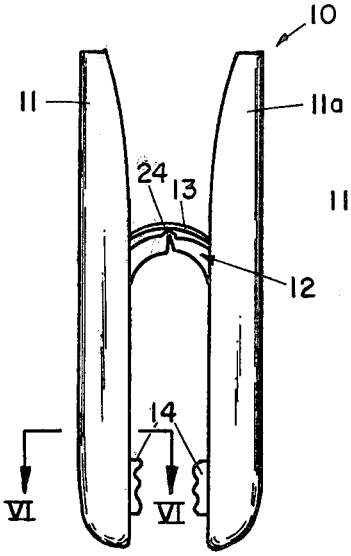
FIG. 3 is a side elevation view of the clamp illustrated in open position.
Figure 1:
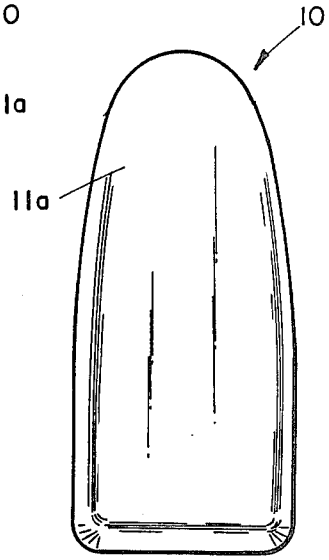
FIG. 1 is a front elevation view of a clamp incorporating this invention.
Figure 4:
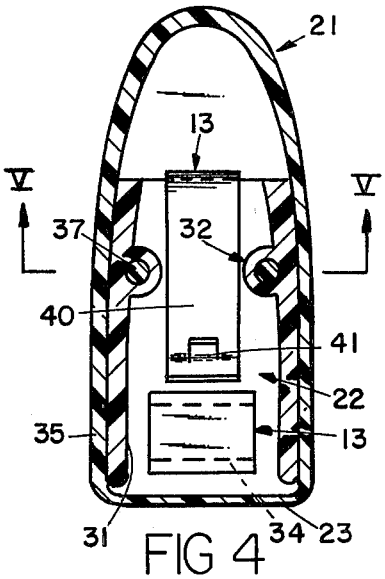
FIG. 4 is a sectional elevation view taken along the plane IV—IV of FIG. 2.

Referring to FIGS. 1, 2 and 3, there is illustrated a clamp 10 having a pair of jaws 11 and 11*a* connected by a bridge 12 and biased into closed or clamping position by a spring 13. In the preferred embodiment, the surfaces which actually contact and grip the article are provided by the inserts 14 which will be described subsequently. The ends of the jaws opposite from those gripping the article form finger pads by which the jaws can be manipulated.

Figure 8:
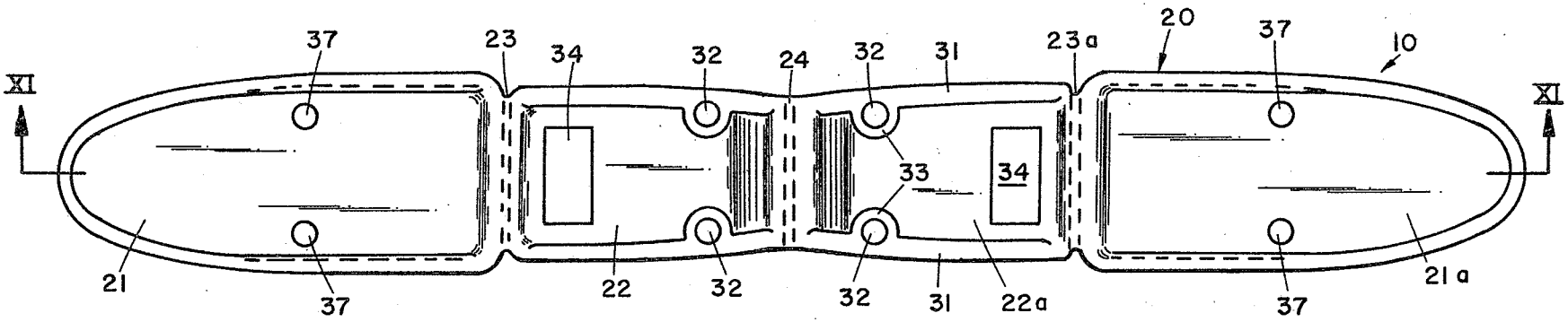
FIG. 8 is a view of the clamp in open, basically flat position as it appears when first removed from the mold.
Figure 9:
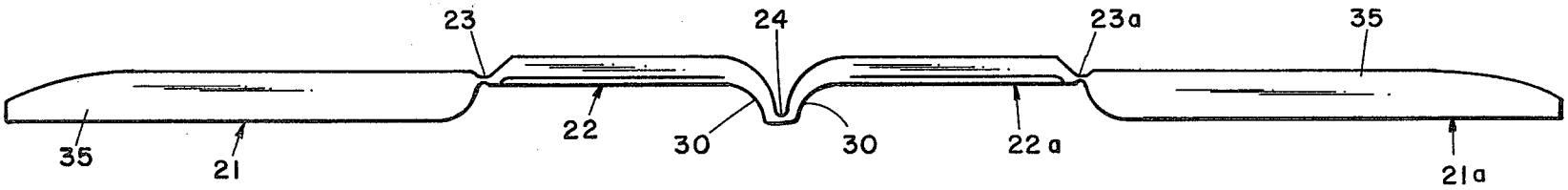
FIG. 9 is a side elevation view of the clamp as it is illustrated in FIG. 8.
Figure 10:
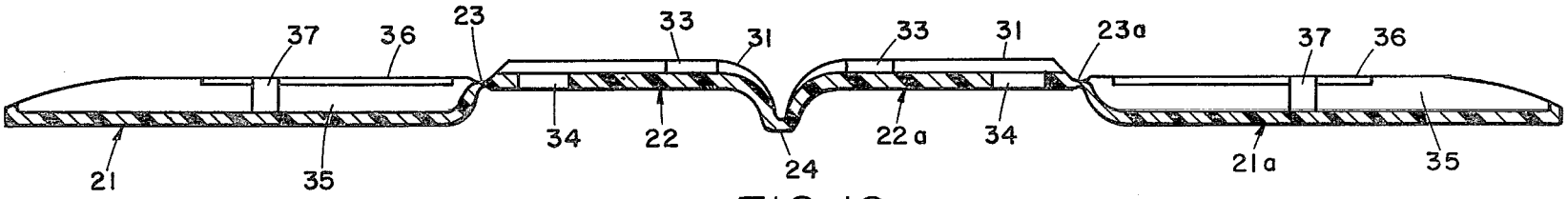
FIG. 10 is a central section view taken along the plane XI—XI of FIG. 8.

As best seen in FIGS. 8, 9 and 10, the body 20 of the clamp 10 has a pair of outer panels 21 and 21*a* and a pair of inner panels 22 and 22*a*. Each of the outer panels is joined to its adjacent inner panel by an integral hinge 23 or 23*a*. The opposite ends of the inner panels are joined by an integral hinge 24. The inner and outer panels and the hinges are all molded simultaneously as a single, integral piece from a suitable plastic having characteristics which will provide a fatigue resisting hinge section to create the hinges 23, 23*a* and 24. Suitable materials include polyethylene and polypropylene. The hinges are formed by webs of reduced thickness and in the designs illustrated by slightly decreased widths.

Each of the inner panels 22 and 22*a* has a central web portion extending from side to side, a substantial portion of which is flat. The central web portion adjacent the hinge 24 has a curved section 30 which, when the two inner panels are folded into operating position forms the arch-like structure of the bridge 12. This structure is joined at the center by the hinge 24. A flange 31 projects away from the plane of the web along each side of each of the inner panels. The flanges project outwardly from the plane of the web when the panels are folded into operative position. A pair of sockets 32 extend in the same direction as the flanges 31 at a position spaced a short distance from the hinge 24. Each of the sockets is surrounded by a wall which at one point is integral with the adjacent flange 31 and projects in the same direction as the flange and to an equal height. In addition, each of the inner panels has an opening 34. The openings 34 are located adjacent the ends of the panels remote from the hinge 24. The openings 34 may be of any suitable shape, but as shown, they are preferably rectangular.

Figure 6:
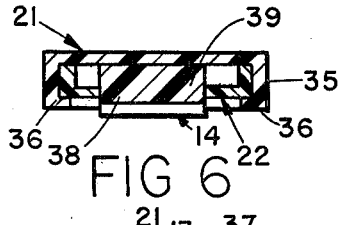
Figure 5:
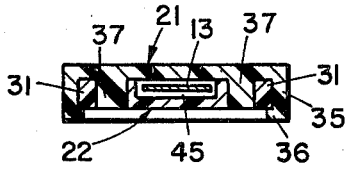
FIG. 5 is an enlarged sectional view taken along the plane V—V of FIG. 4.

Each of the outer panels 20 and 21 has a flat, planar central web portion forming the primary body of the panel. Along both sides and around the free end each panel has a rim 35 which projects inwardly when the panel is folded to operative position. The rim 35 along the main portion of both sides of the outer panel has a shallow, inwardly extending lip 36 (FIGS. 5 and 6). The lip 36 is spaced from the main web portion of the panel sufficiently that it will seat over and lock to the adjacent inner panel when the adjacent inner and outer panel pair are folded to operating position. The height of the flanges 31 of the inner panels is such that when the inner and outer panels are snapped together, they are firmly held because the flanges occupy the entire space between the inner face of the web of the outer panel and the lips 36. At the outer end of the outer panels, the rim 35 tapers toward the web portion of the panel and the lips 36 are phased out.

Each of the outer panels has a pair of posts 37 so located with respect to the adjacent hinges 23 or **23*a* that when the outer panel is folded against the adjacent inner panel, the posts 37 insert into the sockets 32** of the inner panel and further lock the two panels together. The relative diameters of the posts and sockets are such that the posts have a tight interference fit with the socket walls.

FIGS. 8 and 9 illustrate the clamp as it appears when discharged from the mold. It will be noted that the panels 21, 22, **22*a* and 21*a* are arranged in a substantially flat, planar configuration. Since the posts 37 sockets 32 and the openings 34 are all normal to the plane of the panel webs to which they are attached, the entire part can be molded in a single operation without necessitating the use of cams or other moving parts of the mold to eliminate hangup of the molded part on the mold. Although the lips 36 do provide a very small overhang which does produce a degree of hangup, the part can be released because the basic material is resiliently flexible to a limited degree and this flexibility is greater at the time the part is discharged from the mold than later on when it has fully cooled. It is for this reason that the amount or degree of overlap of the lips 36 is limited to only that which is necessary to provide a positive grip between the inner and outer panels. Further, the engagement between the post 37 and the sockets 32** provides the primary frictional interlock between the inner and outer panels when they are pivoted to operative position.

Before the panels are pivoted to operative position, the inserts or article gripping pads 14 are installed. As best seen in FIG. 6, each of the pads 14 is generally T-shaped in cross section and has a leg 38 with a serrated surface and a backing panel 39. The size and shape of the leg 38 is such that it can be press fitted through the opening 34. The backing panel 39 being larger than the opening 34 seats against the outer face of the web portion of the inner panel through which the pad is installed. When the outer panel is folded to its operative position and the posts 37 have been snapped into the sockets 32, the backing panel 39 of each of the pads 14 occupies the space between the inner and outer panels. Thus, the outer panel provides a stop, preventing the pad from being pushed outwardly through the opening 34 when an article is clamped between the jaws 11 and **11*a*. The pads 14** may be fabricated of any suitable material which will not mar the article such as a garment being clamped and provides a surface of limited resilience and having a high coefficient of friction. A suitable material for the manufacture of these pads is a molded rubber.

After the pads 14 have been installed in the openings 34, the clamp can fold. To do this, the inner panels 22 and **22*a* are folded together about the hinge 24. The spring 13 is then installed by seating it over the folded inner panels. The outer panels 21 and 21*a* are there folded into operative position, that is, parallel to the inner panels. Each outer panel, as it reaches its final position, snaps over its adjacent inner panel and becomes detachably secured to it by both the lips 36 and the engagement of the posts 37 and sockets 32**.

Figure 11:
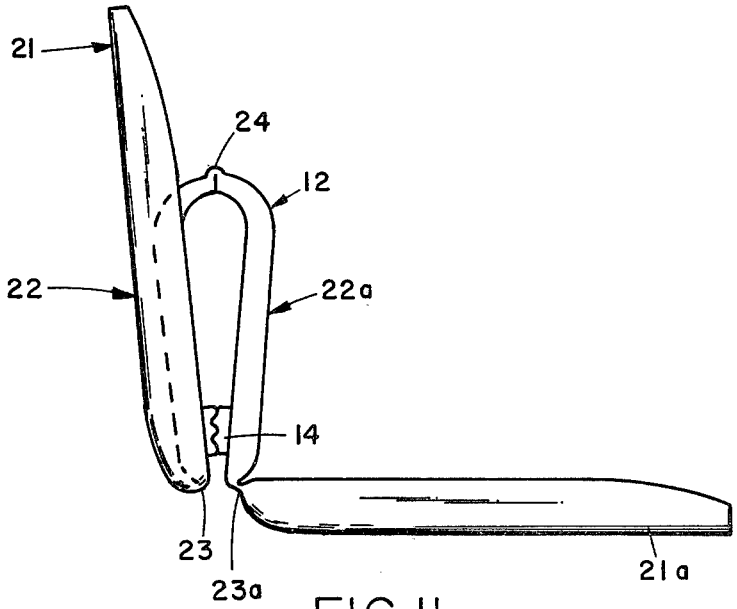
FIG. 11 is a side elevation view of the body of the clamp partially folded into operative condition and prior to assembly of the spring.

FIG. 11 illustrates the relationship of the panels at one point in the folding process, but omitting the spring for clarity. This Fig. illustrates the relationship of the panels after the inner panels have been folded together and after the spring has been installed and one of the outer panels have been pivoted to its final position. It will be recognized that whether the outer panels are pivoted into position simultaneously or in sequence is a matter of choice depending upon the method and equipment used to finally prepare the clamp.

Figure 12:
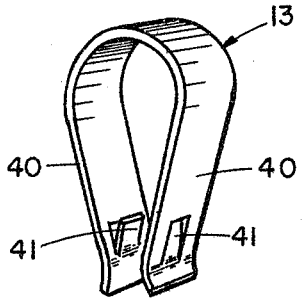
FIG. 12 is an oblique view of the spring used with the clamp.

As best seen in FIG. 12 the spring is of the typical inverted U-shape, having a pair of sides 40 converging toward an open end. Adjacent the open end, each of the sides 40 has a tab 41 bent inwardly. The free ends of the tabs extend toward the closed end of the spring. The tabs have sharp, square ends designed to provide a high frictional engagement with the plastic of the clamp body. The length of the legs 40 is such that, when fully installed but without the closed end necessarily touching the hinge 24, the spring extends a major portion of the length of the inner panels and almost to the pad 14. It will be seen that when the spring is so installed, the tabs 41 resist the spring working itself free of the bridge 12. In addition, the inner panels 22 and **22*a*** may have indentations or openings to receive the tabs, providing a positive interference connection between the spring and the panels. The spring is preferably manufactured from spring steel and suitably hardened to provide a fatigue resistant part which will retain its resilient, spring characteristics over a long period of time.

Once assembled, spring 13, engages the inner panels between the hinge 24 and the pads 14 substantially closer to the pads 14 than the hinge 24. Thus, it biases the jaws 11 and **11*a* of the clamp into closed or article engaging position. The force with which the closing effect occurs is dependent upon the strength of the spring provided, however, that the strength of the spring is not such that it overpowers the bending strength of the outer panels when the user attempts to open the clamp. Since the hinges 23, 23***a* and 24 are all formed as an integral web of the same material from which the inner and outer panels are also molded, the body of the clamp does have a certain degree of resilience but the clamp can and is, in fact, provided by appropriate reinforcement with adequate structural strength to resist significant and undesirable deflection when made from such materials.

The assembly of the inner and outer panels provides, a double walled structure from substantially close to the hinge 24 to the free ends of the jaws adjacent the pads 14. Further, the flanges 35 and the lips 36 reinforce and provide structural strength for the outer panels 21 and 21*a*, particularly in the area of the upstanding wings of finger pad portions 44 which extend beyond the upper ends of the inner panels and provide the gripping portions by which the user can manipulate the clamp. This arrangement provides a product having sufficient deflection resistance that the spring 13 can have enough strength to impart an adequate clamping force to suspend heavy articles such as blankets or carpet samples from the device. Since the inner and outer panels are integral at the clamping ends of the jaws, there is a positive attachment between these panels where the greatest separation force is applied. The existence of the peg and socket arrangement maintains positive alignment between the inner and outer panels, thus, providing stability to the clamping device.

The double wall construction created by the assembly of the inner and outer panels creates a pocket 45 between the panels (FIG. 5). The legs 40 of the spring 13 are seated in this pocket. The pocket conceals the spring and at the same time provides sufficient clearance for the spring that it may flex without binding that would impair its clamping function.

Figure 14:
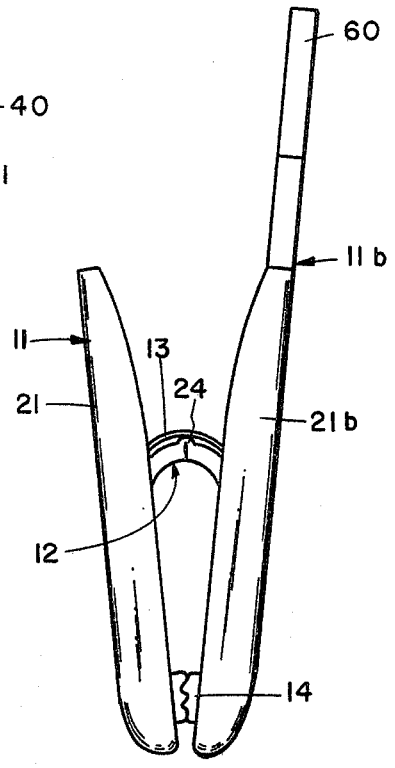
FIG. 14 is an end elevation view of the clamp illustrated in FIG. 13.
Figure 13:
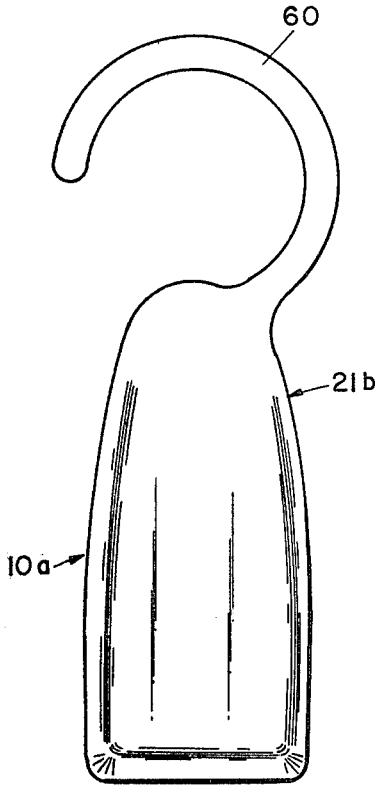
FIG. 13 is a front elevation view of a modified form of the clamp.

It will be recognized that the invention can be converted from a simple "clothes-pin" type of product to a hanger capable of being supported from a rod or peg simply by adding a hook to one of the outer panels. Such an arrangement is illustrated in FIGS. 13 and 14 where a hook 60 is molded integral with the outer panel 21*b* of the jaw 11*b*. In this arrangement, the other outer panel 21 of the clamp 10*a* is identical to that illustrated in FIGS. 1 through 11. The remainder of the clamp is unchanged.

Figure 16:
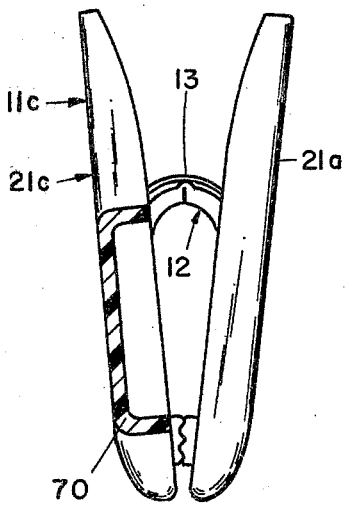
FIG. 16 is a sectional elevation view taken along the plane XVI—XVI of FIG. 15.
Figure 15:
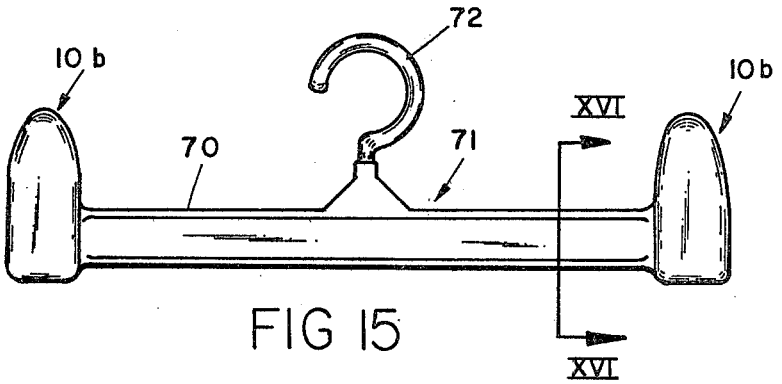
FIG. 15 is a front elevation view of a slack or pant hanger incorporating this invention.

FIGS. 15 and 16 illustrate the invention applied to a garment changer of the type particularly suited for suspending slacks, skirts and the like. In this case, the jaw 11*c* of each of the clamps 10*b* has an outer panel 21*c* integral with the cross bar 70 of the hanger 71. The hook 72 can be either molded integral with the cross bar 70 or it can be a separate piece attached to the bar after molding.

It will be recognized that the invention may also be applied to a contoured, molded plastic hanger for mens suits having a pants bar or to the flat type of molded plastic hanger used for womens clothing having a cross bar on which clips are provided for suspending a skirt, petticoat or the like. Conventional construction for these types of hangers are exemplified, respectively, by U.S. Pat. No. 3,406,881, entitled CONTOURED ONE-PIECE HANGER, issued Oct. 22, 1968, reissued Sept. 8, 1970 as U.S. Pat. No. Re.26 949 and U.S. Pat. No. 2,666,240, previously noted.

In this case, the clamps illustrated as molded on the ends of the hanger 71 of FIG. 15 are simply molded integral with the pants or cross bar of the hanger.

Figure 17:
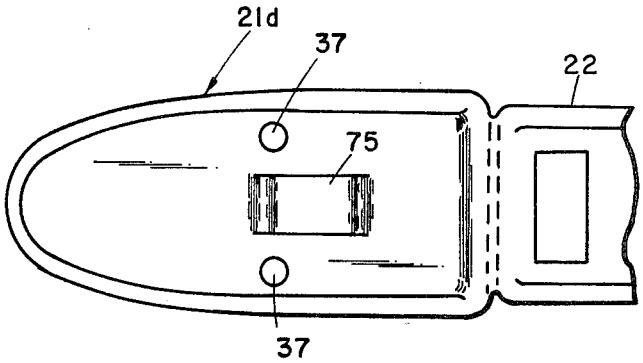
FIG. 17 is a fragmentary view similar to FIG. 9 of a modified form of the invention.
Figure 18:
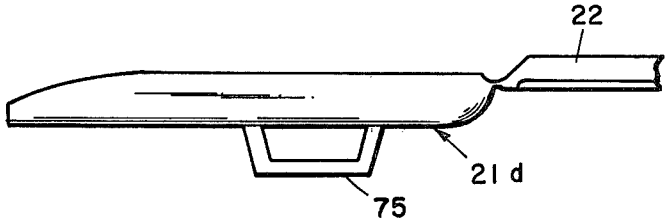
FIG. 18 is a fragmentary side elevation view of the modification illustrated in FIG. 17.

If it is desired to make the spacing between the clamps adjustable, the clamps may be molded separately and provided with a loop which can be slipped around the cross bar if the cross bar is manufactured separately from the main body of the hanger. Such an arrangement is shown in FIGS. 17 and 18 wherein one of the outer panels 21*d* is provided with an offset strap 75 molded integral with the web portion of the panel. This can be done without moveable cams in the die since one portion of the die projects through the panel to form the strap 75. This strap may be semicircular or may be generally rectangular, as shown, if the bar itself is rectangular in cross section and it is desired to prevent the clamp from pivoting about the bar. Once again, these are but modifications of the basic concept of this invention.

Irrespective of whether the invention is incorporated in the simple clamp as illustrated in the FIGS. 1, 2 and 3 or in the clamp with the hook whereby it may be hung from a support as illustrated in FIGS. 13 or 14, or incorporated in a hanger for pants, slacks and the like as illustrated in FIGS. 15 and 16 the clamp is molded as a single integral piece and the spring is internally concealed. The invention eliminates the assembly of a number of separate individualplastic components to provide the finished product. It also conceals the spring. In the case of all of these products, the only operations which must be performed on the product after it has been removed from the mold are those of folding the panels into their final configuration as suggested in FIG. 8 and installing the spring clip. The molding of the inner and outer panels and, if necessary, the supporting hanger structure as a single piece substantially reduces the cost of the part by materially reducing the direct labor factor involved in the part's manufacture. Further, because the entire part can be made as a single piece in a relatively simple mold, not only is the basic initial investment in the mold or molds materially reduced but a single molding machine, utilizing only a single cycle, can produce a complete hanger. This again is a material reduction in the cost of producing the product. To add to this, the steps of folding the inner and outer panels into their assembled functional relationship and the installation of the spring are functions which can be readily automated, thus, further reducing the direct labor costs of producing the product.

All of this has been done, not only without adversely affecting the functional characteristics of the finished product, but, in fact, with actual improvement of these characteristics because the product is neither likely to fail nor are there individual parts which can become disassembled during use, thus, either functionally destroying the product or frustrating the user because of the necessity of reassembly.

The product conceals the spring and, in fact, conceals basically all of the functional facets of the product permitting its aesthetics to be materially improved over that of products of this type heretofore available on the market. Because of the manner in which the inner and outer panels are joined together and the fact that the pivotal motion occurs about a hinge which is spaced from both of the outer panels, there is no point in the outer panels subject to a concentrated bending load to cause rupture and fatigue. Thus, the invention avoids the difficulties of the conventional "clothes-pin" type structure which pivots about a single rigid fulcrum such as is common in pincher type structures of conventional design.

While a preferred embodiment and several modifications of the invention have been described, it will be recognized that other modifications of the invention may be made without departing from the principles of the invention. Such modifications are to be considered as included in the hereinafter appended claims unless these claims, by their language, expressly state otherwise.

The embodiments of the invention in which an exclusive property or privilege is claimed are defined as follows:

1. A clamp for engaging and holding articles, said clamp having a pair of jaws hingedly joined together and spring means biasing one end of said jaws into closed, article clamping position, each of said jaws having normally divergent finger pads projecting from the hinge joint of said jaws oppositely from said one end of said jaws, said clamp characterized in that it has a pair of outer panels and a pair of inner panels, each outer panel being integral with and hingedly joined to one of said inner panels said inner panels being integral and connected to form said hinge joint between said jaws which hinge joint acts as a fulcrum about which said jaws are pivoted as said clamp is opened and closed; each of said outer panels being seated against a portion of one face of the adjacent one of said inner panels to form one of said jaws and means to secure the inner and outer panels of each jaw in abutting relationship; said inner and outer panels being moldable from plastic as a single piece.

2. The clamp described in claim 1 further characterized in that said securing means includes a pair of elements on said outer panels which engage and lock to the sides of said inner panels.

3. The clamp described in claim 1 further characterized in that said securing means includes a pair of sides projecting normal to the plane of the outer of said panels having inwardly extending lips which resiliently seat over and clamp about the inner ones of said panels.

4. The clamp described in claim 1 further characterized in that said securing means includes a pair of posts on one of each pair of said inner and outer panels and a pair of sockets on each pair of the other thereof; said posts being inserted in and having a tight frictional fit with said sockets when said inner and outer panels are folded into basically parallel operative position.

5. A clamp as described in claim 1 further characterized in that each of said outer panels has a pair of inwardly extending edge flanges and each of said inner panels has a pair of outwardly projecting edge flanges extending toward said inner panel; said edge flanges reinforcing said panels and when said panels forming a jaw are folded into adjacent, parallel, operative position, said edge flanges of one panel snugly interfit between the edge flanges of the other panel.

6. A clamp as described in claim 5 further characterized in that one of the panels of each jaw has a post and the other panel a socket, said post being inserted into said socket and forming a tight interference fit therewith when said panels are folded to form a jaw.

7. A clamp as described in claim 1 further characterized in that said securing means is a post on one of said panels and a socket on the other thereof, said post being inserted into said socket and forming a tight interference fit therewith when said panels are folded to form a jaw.

8. A clamp as described in claim 1 further characterized in that one of said panels has edge flanges, said flanges spacing said portions of said panels to form a pocket therebetween; said spring being U-shaped and having a pair of legs, said legs being received within said pocket.

9. A clamp as described in claim 1 further characterized in that said spring is U-shaped and has a pair of legs; offset portions adjacent the free ends of said legs inclined toward each other, said offset portions providing a positive interference engagement with said inner panels to hold said spring against lengthwise movement.

10. A clamp as described in claim 1 further characterized in that a resilient, article-engaging pad is mounted to each of said jaws adjacent said one ends thereof.

11. A clamp as described in claim 10 further characterized in that each of said inner panels has an aperture therethrough, said pads having a portion inserted through one of said apertures and seated against the adjacent one of said outer panels for supporting said pads against displacement when said jaws are clamped together.

12. A clamp for engaging and holding articles, said clamp having a pair of jaws hingedly joined together and spring means biasing one end of said jaws into closed, article clamping position, each of said jaws having normally divergent finger pads projecting from the hinge joint of said jaws oppositely from said one end of said jaws, said clamp characterized in that it has a single integral body member, said body member having a pair of outer panels and a pair of inner panels, each outer panel being hingedly joined to one of said inner panels, said inner panels being connected to form said hinge joint between said jaws which hinge joint acts as a fulcrum about which said jaws are pivoted as said clamp is opened and closed; the adjacent inner and outer panels being folded together and means holding said panels in folded position to form each of said jaws.

13. A clamp as described in claim 12 further characterized in that said holding means includes interfitting portions forming a detachable, frictional interlock between the panels.

14. A clamp as described in claim 12 further characterized in that said spring is seated between said inner and outer panels of each jaw.

15. A clamp as described in claim 14 further characterized in that said spring engages said inner panels only.

16. A clamp as described in claim 13 further characterized in that said spring is seated between said inner and outer panels and engages only the inner panel of each jaw.

17. A clamp as described in claim 12 further characterized in that a supporting hook is integral with and extends from the finger pad end of one of said jaws.

18. A clamp as described in claim 17 further characterized in that said body member and hook are molded from plastic simultaneously as one, substantially flat piece.

19. A hanger for articles, said hanger having a pair of clamps, a clamp connecting member and a supporting hook connected to said member; each of said clamps having a pair of jaws hingedly joined together and spring means biasing one end of said jaws into closed, article clamping position, each of said jaws having normally divergent finger pads projecting from the hinge joint of said jaws oppositely from said one end of said jaws, said clamp characterized in that it has a single integral body member, said body member having a pair of outer panels and a pair of inner panels, each outer panel being hingedly joined to one of said inner panels, said inner panels being connected to form said hinge joint between said jaws which hinge joint acts as a fulcrum about which said jaws are pivoted as said clamp is opened and closed; the adjacent inner and outer panels being folded together and means holding said panels in folded position to form each of said jaws; said connecting member being joined to one of said jaws of each of said clamps.

20. A hanger for articles as described in claim 15 further characterized in that said connecting member is joined to the outer panel of one of said jaws of each of said clamps.

21. A hanger for articles as described in claim 20 further characterized in that said connecting member and body member are molded from plastic simultaneously as one substantially flat piece.

* * * * *

UNITED STATES PATENT AND TRADEMARK OFFICE

CERTIFICATE OF CORRECTION

PATENT NO. : 4 192 441

DATED : March 11, 1980

INVENTOR(S) : John H. Batts

Figure 7:
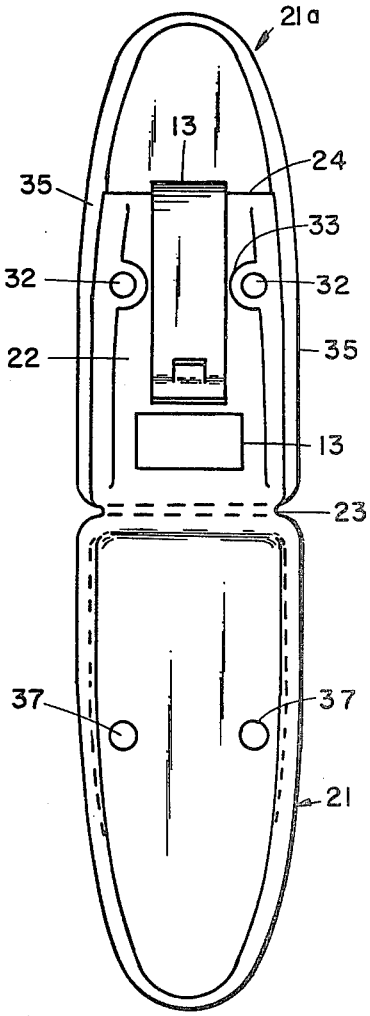
FIG. 7 is an enlarged view taken along the plane VI—VI of FIG. 3.

It is certified that error appears in the above-identified patent and that said Letters Patent are hereby corrected as shown below:

Column 2, line 5:

"Fig. 7" should be --Fig. 6--

Column 5, line 50:

"changer" should be --hanger--

Column 6, line 28:

"individualplastic" should be --individual plastic--

Signed and Sealed this

*Twenty-second* Day of *July 1980*

[SEAL]

*Attest:*

SIDNEY A. DIAMOND

*Attesting Officer*

*Commissioner of Patents and Trademarks*